United States Patent [19]

Kampe

[11] Patent Number: 4,747,939

[45] Date of Patent: May 31, 1988

[54] PARTICLE CLASSIFIER

[76] Inventor: Johannes F. E. Kampe, 4105 W. 234th St., Torrance, Calif. 90505

[21] Appl. No.: 800,958

[22] Filed: Nov. 22, 1985

[51] Int. Cl.[4] ..... B07B 9/00

[52] U.S. Cl. ..... 209/20; 209/21; 209/30; 209/639; 209/641; 209/642

[58] Field of Search ..... 209/638, 639, 20, 21, 209/30, 31–33, 36, 37, 641, 642

[56] References Cited

U.S. PATENT DOCUMENTS

| | | | |
|---|---|---|---|
| 466,730 | 1/1892 | Vellines | 209/642 |
| 1,966,988 | 7/1934 | McKenna | 209/20 X |
| 2,224,169 | 12/1940 | Turnbull | 209/639 X |
| 2,446,140 | 7/1948 | McGee | 209/20 X |
| 2,713,977 | 7/1955 | Noll | 209/30 X |
| 2,796,173 | 6/1957 | Payne et al. | 209/144 |
| 3,734,287 | 5/1973 | Jager | 209/139.2 |
| 3,878,995 | 4/1975 | Nash | 209/638 |
| 4,222,858 | 9/1980 | Avila et al. | 209/133 X |
| 4,507,197 | 3/1985 | Koenig et al. | 209/30 X |

*Primary Examiner*—Joseph J. Rolla
*Assistant Examiner*—David H. Bollinger
*Attorney, Agent, or Firm*—Fulwider, Patton, Rieber, Lee & Utecht

[57] ABSTRACT

The invention is directed to a method and system for classifying particulate matter wherein unclassified particulate is projected into a spiraling fluid stream passing through an annular classifying zone. The particulate is projected into the fluid stream from the inner boundary of the classifying zone and the particulate passes through the fluid stream according to the size or density of the particles thereby facilitating the classification of the particles. The fluid stream with the particulate entrained therein is separated into a plurality of annular streams at the end of the classification zone thereby separating the particulate into distinct size fractions.

16 Claims, 3 Drawing Sheets

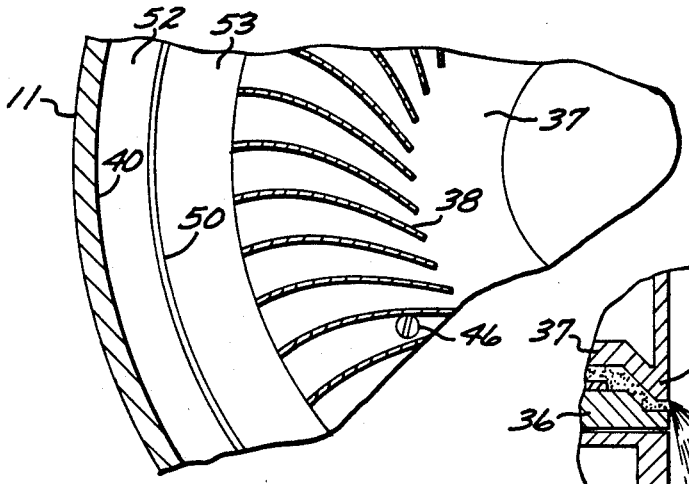
FIG. 6
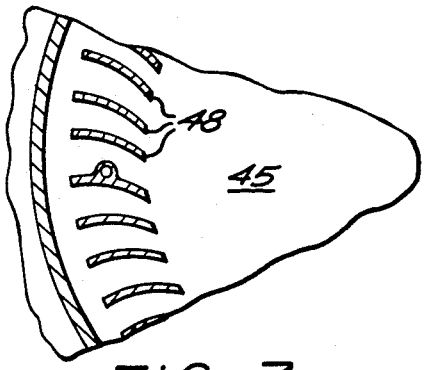
FIG. 7
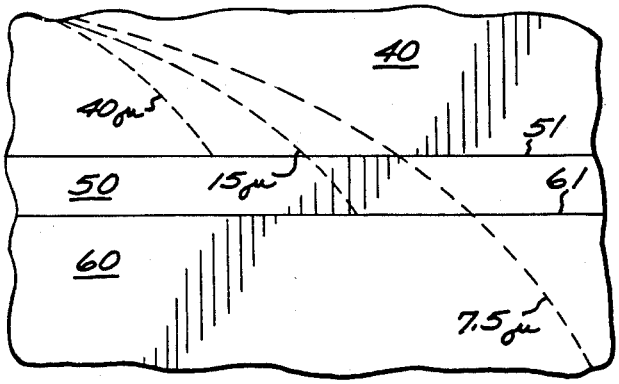
FIG. 9
FIG. 8
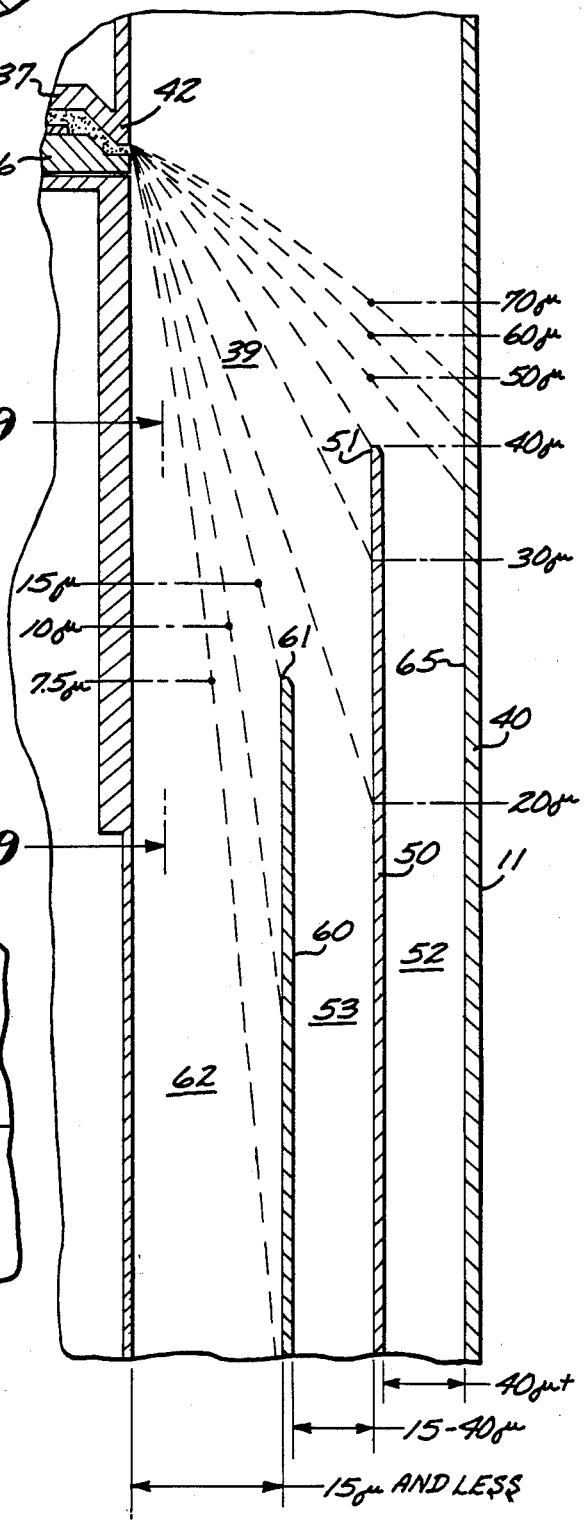

PARTICLE CLASSIFIER

BACKGROUND OF THE INVENTION

This invention generally relates to the field of classifying finely divided particulate matter into fractions of different sized particles.

A wide variety of classification systems have been developed employing a classification zone wherein unclassified particles are projected into a moving fluid, such as air, to segregate the particulate matter into fractions according to their particulate size and/or density.

One of the more effective types of classification systems is that shown in U.S. Pat. No. 2,796,173 (Payne, et al.) and U.S. Pat. No. 3,334,740 (Hoffstrom). In these systems, particulate matter is fed to the top of a rapidly rotating table which accelerates the particulate matter to the rotational velocity of the table and projects the particles tangentially from the edge of the table into a horizontally and inwardly flowing fluid stream. Two forces act on the particles in the fluid stream, the centrifugal force which tends to push the particles outwardly and an aerodynamic drag force tending to sweep the particles inwardly with the fluid stream. The centrifugal force has a much more predominant effect on the larger or heavier particles than does the drag force so there is a good size separation between the particles thrown outwardly and the particles carried inwardly by the fluid stream.

The apparatus in the above separation systems were very complex and thus very expensive to manufacture and maintain. Moreover, once the desired cut point size between the various sized particle fractions was set, it could not be readily changed. The velocity of the gas through the separation zone could be varied to change the cutpoint size, but changing the velocity severely restricts the useful capacity of the separation system, particularly in a closed loop grinding system.

Another separation system, designed to conduct particle size analysis on small test samples of particulate matter, is shown in U.S. Pat. No. 3,141,337 (Hoffstrom). In this system, the particulate matter is projected radially through a fluid stream passing axially through an annular, classification zone and is collected according to the size and/or density of the particles on the inside of a removable wall which forms the outer boundary of the classification zone. This device was designed for particle analysis of small samples and not for the continuous classification of large quantities of particulate matter in an industrial facility.

Thus, there remains a need for a separation or classification system which can provide a sharp size separation of particles into a plurality of fractions and, particularly, one in which the cut off size between different sized fractions can be readily varied with a constant throughput capacity. The classification system of the present invention satisfies this need.

SUMMARY OF THE INVENTION

This invention is directed to an improved classification system for separating particulate matter into a plurality of fractions according to particle size and/or density.

In accordance with the invention, particulate matter is introduced into a fluid stream which is moving axially through an annular, cylindrically shaped classification zone at the inner boundary thereof. The particulate matter passes radially through the moving fluid stream in accordance with the size or density of the individual particles. Means are provided at the end of the classification zone to separate the particulate laden fluid stream into two or more annular fluid streams to thereby separate the different sized particle fractions entrained therein.

The moving fluid stream preferably has a tangential velocity component perpendicular to the axial component so that the stream spirals through the classification zone. Unclassified particulate is projected into the spiraling fluid stream at a velocity with little or no radial component, but with a tangential component of essentially the same magnitude and direction as the tangential velocity component of the fluid stream at the particulate discharge point at the inner boundary of the classification zone.

The larger and/or denser particles traverse the fluid stream in the classification zone to a greater extent and more quickly than the smaller and/or less dense particles, and the smaller particles are carried axially along with the fluid stream for a longer period and to a greater distance than the larger or denser particles, thereby greatly enhancing the desired particle size separation.

In a preferred embodiment, the classifier is provided with one or more concentric, cylindrically shaped dividing walls at the end of the classification zone and coaxial therewith which divide the spiraling, particulate laden fluid stream flowing therein into separate annular streams within collection zones formed, at least in part, by the dividing walls. The dividing walls are vertically positioned within the collection zone so that the upper or leading edge thereof intercept the trajectory of particles of the cut point size in order to accurately separate the particulate carried by each of the separated streams into distinct size ranges with very little overlap. The particles larger than the cut point size are entrained in the fluid stream separated in an outer collection zone and generally will impinge on the interior of the outer-wall of the classification zone, whereas, the particles smaller than the cut point size are entrained in the fluid stream separated in the adjacent collection zone and generally will impinge on the interior of the dividing wall.

Means to raise and lower the dividing walls are provided to facilitate adjustment of the size separation between particulate fractions. The particle fractions entrained in each of the separated fluid streams are swept through the collection zone and then directed to suitable separation means such as cyclones, filter bags and the like to remove the classified particle fractions from the fluid streams.

Alternatively, the desired particle size separation may be controlled by utilizing one or more dividing walls of various diameters in the classification zones in lieu of raising and lowering the dividing walls.

In a preferred embodiment, particulate matter is projected into the fluid stream by feeding the particulate onto the top of a rotating table where it is uniformly distributed over the table top and is accelerated by frictional contact therewith. The table is provided with drive blades disposed along the outer top portion thereof to accelerate the particulate to the rotational velocity of the table prior to being projected from the table tangentially into the separating fluid stream. A diverter, which is rotating at the same angular velocity as the table, is provided around the edge thereof to reduce the radial or outward velocity of the projected particulate into the fluid stream to a negligible level. The use of the diverter ensures the formation of uniform curtain of particulate matter at the entrance of the classification zone through which the fluid must pass, thereby facilitating efficient particle separation.

The air curtain spiraling through the classification zone is generated by a blower assembly comprising a plurality of blades disposed around the edges of a support cover which is attached to the table. The blades of the blower assembly rotate at the same angular velocity as the table, so the tangential velocity components of the fluid stream is the same as the peripheral velocity of the edge of the table and, thus, the entering tangential velocity of the particles entering the fluid stream.

In the apparatus of the invention, the particle size range in each of the separated fractions can be readily changed by raising or lowering the dividing walls or by replacing the dividing wall with dividing walls having different diameters. The system responds immediately to cut point size changes without the need to adjust the feed rate of particulate matter to the classifier or the rotational speed of the distributor table. The throughput of the apparatus is independent of the cut point size. The separation system of the invention is suitable for both small, laboratory sized particle classifiers as well as large production units with capacities of over 100 tons per hour.

These and other advantages of the invention will become more apparent from the following detailed description when taken in conjunction with the accompanying exemplary drawings.

BRIEF DESCRIPTION OF THE DRAWINGS

FIG. 6 is a partial cross-sectional view taken along the lines 6—6 in FIG. 3 illustrating the blades which generate the moving fluid in the classification zone.

FIG. 7 is a partial cross-sectional view taken along the line 7—7 in FIG. 3 illustrating the drive blades which accelerate particulate matter on the distributing table to the rotational velocity thereof.

FIG. 8 is an elevational view taken in section transverse across the classification zone illustrating particulate separation.

FIG. 9 is a partial side view taken along the line 9—9 in FIG. 8 further illustrating particle separation.

DETAILED DESCRIPTION OF THE INVENTION

Figure 1:
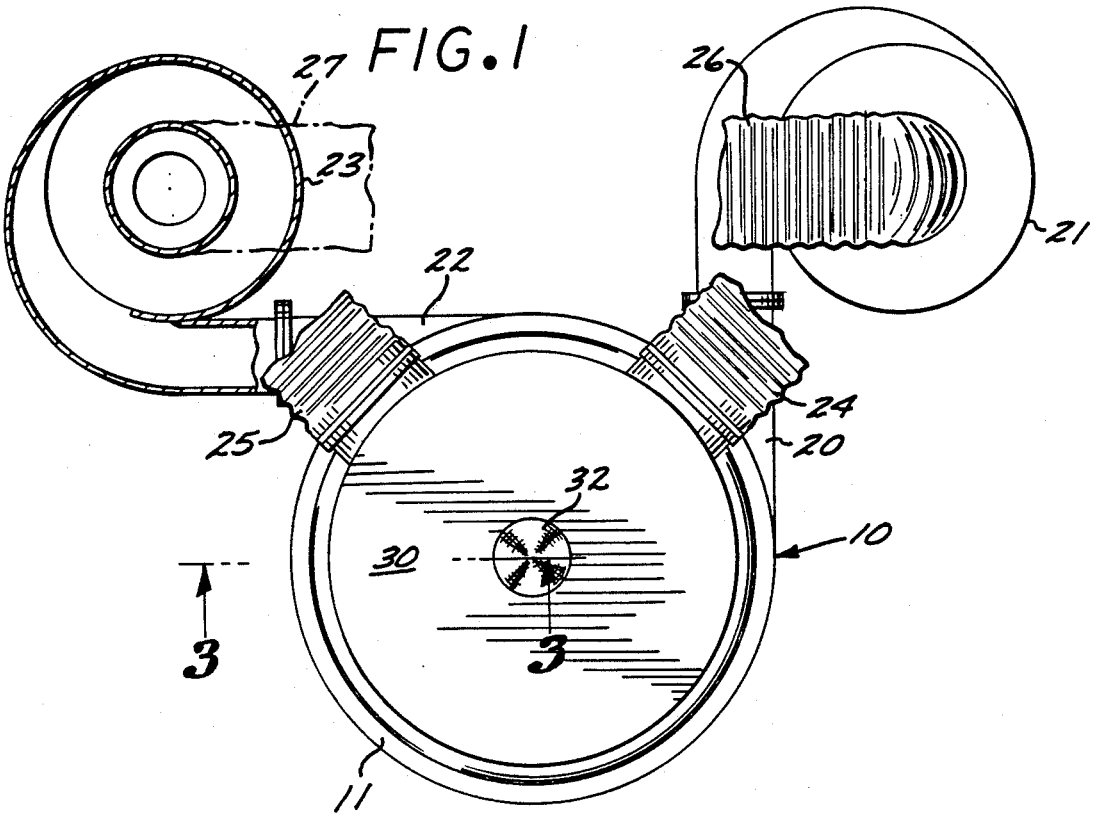
FIGS. 1 and 2 are, respectively, plan and elevational views of a particle classifying system which embodies features of the invention.
Figure 2:
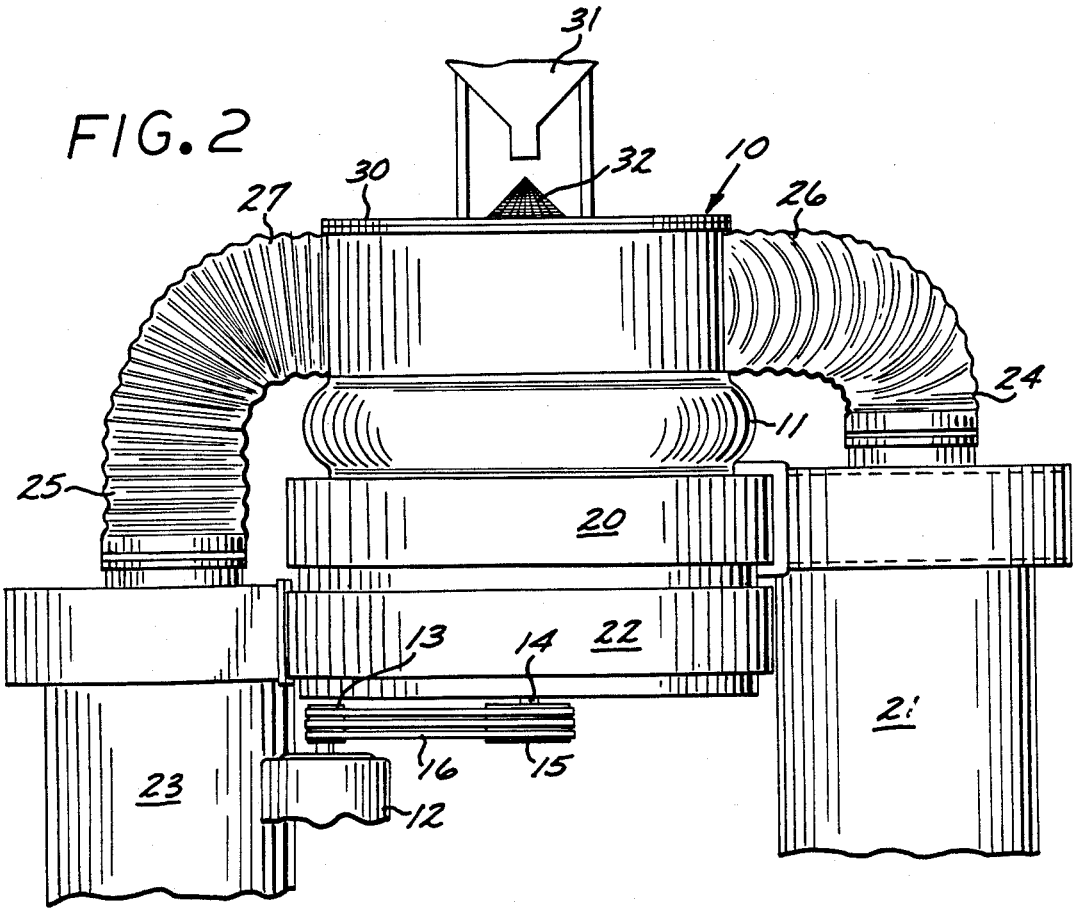

Reference is made to FIGS. 1 and 2 which illustrate a particle classification system which embodies features of the invention. The classification system shown includes a classifier 10, a housing 11, a drive motor 12, and pulley 13 connected thereto, rotor drive shaft 14 and pulley 15 connected thereto, and power transmitting belts 16 which ride on the pulleys 13 and 15. A conduit 20 is provided to direct a first fluid stream having coarse particles entrained therein from the classifier 10 to a first cyclone separator 21 wherein the coarse particles are separated from the fluid stream, and a second conduit 22 is provided to direct a second fluid stream having fine particles entrained therein from the classifier 10 to a second cyclone separator 23 wherein the fine particles are separated from the fluid stream.

Exhaust lines 24 and 25 recycle the working fluid, usually air, from the cyclones 21 and 23 to the classifier 10 through recycle ducts 26 and 27. While not shown in the drawings, one or more suction blowers are connected to the exhaust lines 24 and 25 to draw the particle laden fluid streams from the classifier 10 to the cyclones 21 and 23 wherein the particulate is removed. The very fine particulate which is carried along with the recycled fluid stream is preferably removed therefrom by suitable means such as a bag house (not shown) so that an essentially particulate-free fluid stream is returned through recycle ducts 26 and 27 to the upper portion 30 of classifier housing 11.

A hopper 31 is provided on the top of the housing 11 to feed unclassified particulate matter through conically shaped screen 32 into the interior of the housing 11. The screen 32 ensures that no large particles or other debris enter the classifier 10 which might block conduits and passageways therein.

Figure 3:
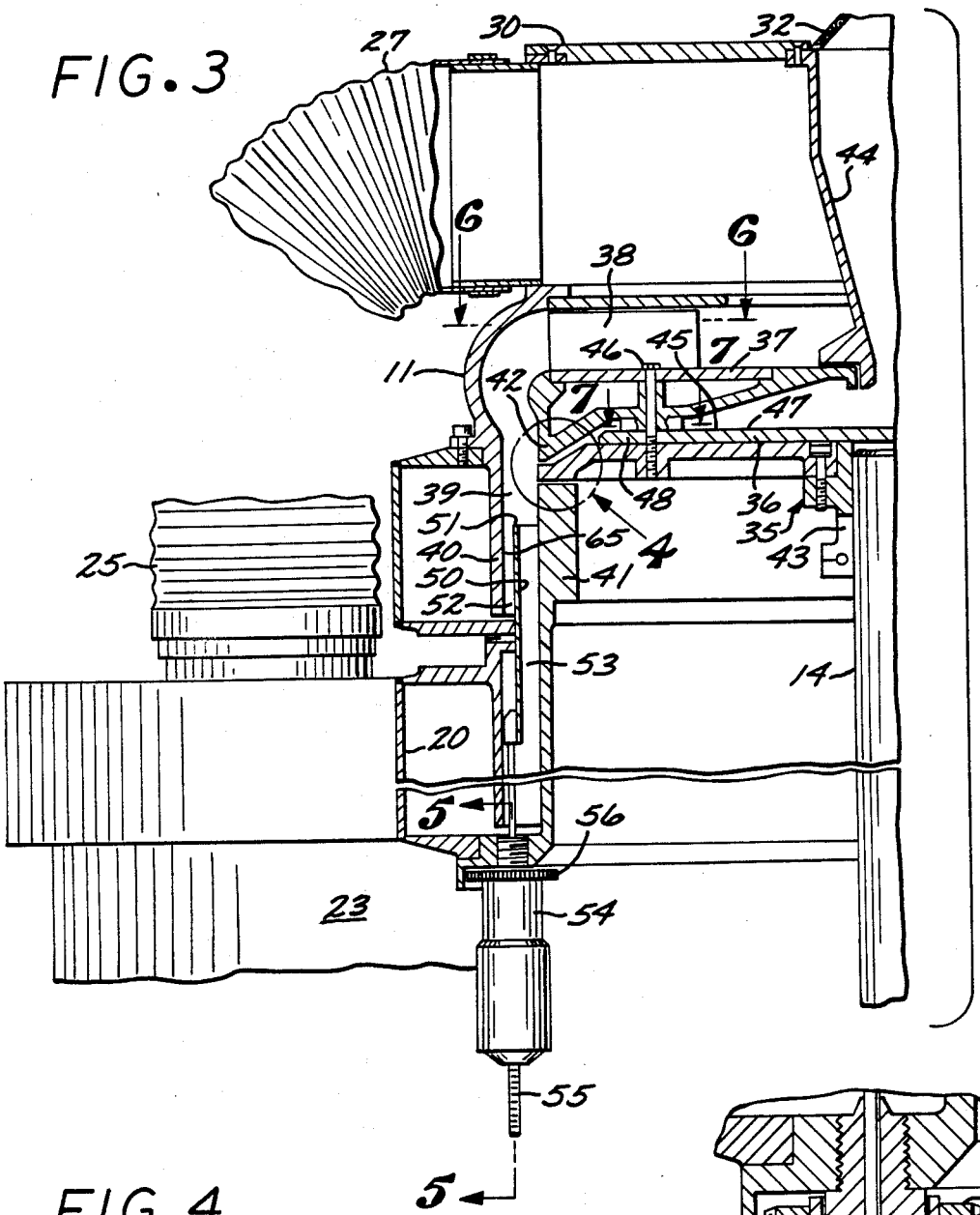
FIG. 3 is a partial cross-sectional view taken along the lines of 3—3 in FIG. 1.
Figure 4:
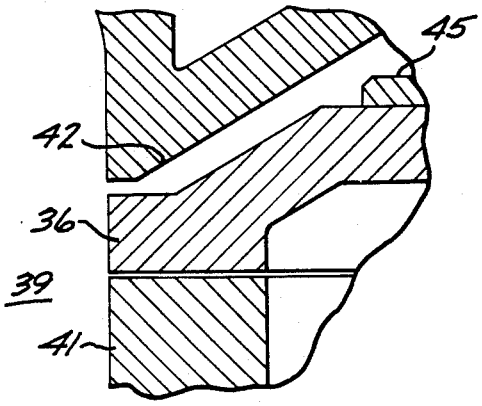
FIG. 4 is an enlarged view of the area shown in FIG. 3 by the circle 4.

FIG. 3, which is a cross-sectional view taken along the line 3—in FIG. 1, illustrates the internal details of classifier 10. Included is a rotor assembly 35 having a particulate distributing table 36, a table cover 37 and a plurality of blades 38 on the upper surface of cover 37 which generate a spiraling, axially moving fluid stream within annular classification zone 39 which is coaxial with the rotor assembly 35. The outer and inner boundaries of annular classification zone 39 is defined in part by cylindrical wall 40 of the housing 11 and an internal wall 41, respectively, which are coaxial and concentric with the classifying zone 39. The table cover 37 is provided with a depending lip or disperser 42 which reduces the radial velocity of particulate projected from the distributing table 36 to insignificant levels.

The rotor assembly 35 is fixed to the rotor drive shaft 14 by means of a collar 43, which supports the particle distribution table 36. A particulate feeding funnel 44 passes through table cover 37 to direct unclassified particulate matter which passes through the conical screen 32 to the upper surface 45 of table 36. The table cover 37 is fixed to the table 36 by bolts 46 and defines with the upper surface 45 of table 36 a passageway 47 for the movement of unclassified particulate matter from the funnel 44 to the classifying zone 39.

As shown in FIGS. 3 and 7, curved blades 48 are provided on the outer portion of the table top 45 to accelerate the particulate matter distributed thereon so that the tangential velocity thereof upon discharge from the table top 45 is essentially equivalent to the tangential velocity of the table top 45. The depending lip or diverter 42 on the table cover 37, which reduces the radial velocity of the particulate from the table top 45 to a negligible level and further increases the tangential velocity of the particles projected into the classification zone 39 to essentially the same tangential velocity of the periphery of table 36.

Figure 5:
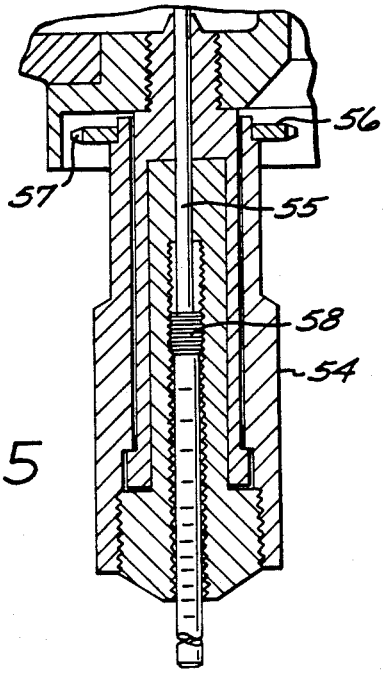
FIG. 5 is a cross-sectional view taken along the line 5—5 in FIG. 3 illustrating the mechanism for raising and lowering the dividing wall.

The diverter 42 ensures that a continuous particulate stream of uniform density is projected from the entire perimeter of table 36 into the classification zone so that a continuous curtain of particulate is presented to the spiraling stream. A vertically movable, cylindrically shaped dividing wall 50 is disposed at the end of the classification zone 39 concentrically and coaxially with the walls 4O and 41 which define, at least in part, the outer and inner boundaries, respectively, of the classifying zone 39. The vertical position of the leading edge 51 of the dividing wall 50 controls the cut point of the particle classification between annular particle collection zones 52 and 53 for the coarse and fine particles, respectively. As shown in FIGS. 3 and 5, the mechanism 54 and the operating rod 55 thereof which is attached to the dividing wall 50 facilitate the vertical movement of the dividing wall 50. The mechanism 54 is operated by rotating the sprocket 56 with teeth 57 which causes the threaded collar 58 on the rod 55 and thus wall 50 to move upwardly and downwardly. While only one mechanism 54 and operating rod 55 are shown, three or more are preferably equally spaced under the annular particle collection zone 53. A suitable drive chain (not shown) may be used to engage the teeth 57 on each of the sprockets 56 so that each of the mechanisms 54 disposed under the collection zone 53 can be operated simultaneously and to the same extent in order to raise wall 50 evenly.

FIG. 8 illustrates a modified classification zone 39 wherein an additional divider wall 60 is provided to form three separate collection zones, coarse particle collection zone 52, intermediate size particle collection zone 53 and a fine particle collection zone 61. The two divider walls 50 and 60 separate the particulate laden fluid stream from the classification zone 39 into three streams, each of which have particles with distinctly different particle size (or density) ranges.

In the operation of the classification system, unclassified particulate is fed to the classifier 10 from hopper 31 through screen 32 to the top 45 of table 36 by means of funnel 44. The rotor assembly 35 is designed to be rotated at very high rates, e.g., from about 200 to about 7,500 rpm, depending upon the size of the rotor 35, so that when particulate matter is placed on the top 45 of the table 36, the particulate matter is quickly and uniformly distributed over the top thereof, and the frictional contact of the particles with the table top 45 accelerates the angular velocity thereof about the axis of the rotor assembly 35 and table 36. The blades 48 on the table top 45 and the diverter 42 bring the particles up to the rotational velocity of the table so that, when the particulate matter is projected from the edge of the table 36, the tangential velocity component of the projected particles is essentially equal to the tangential velocity component of the fluid at the edge of the table 36. The depending lip or diverter 42 reduces the radial velocity of the particles leaving the surface 45 of the table 36 to insignificant levels, but further accelerates the particulate from the table top 45 by contact friction to essentially the same tangential velocity as the fluid moving through the classification zone 39.

The blades or vanes 38 fixed to the top of the table cover 37 generate the spiraling, axially moving curtain of fluid, preferably air, which passes by the edge of the table 36 with tangential velocity component essentially the same as the edge of the table 36 and the particles which are projected therefrom. The outside diameters of the vanes 38 are sized to compensate for frictional losses so that the horizontal component of the tangential velocity of the fluid stream at the edge of the table 36 is as close as possible to the tangential velocity of the particulate leaving the table 36 and projected into the fluid stream.

The particles projected into the spiraling annular fluid curtain within the classification zone 39, are subject to primarily two forces, centrifugal forces and the aerodynamic drag forces, which act on the particles to change their relative movement through the air stream and thereby effect their distribution and their size classification therein. The larger and/or heavier particles pass quickly through the air curtain; contact the inner surface 65 of wall 40 and are thereby separated into an annular fluid stream in the collection zone 52. The finer particles on the other hand, move radially through the fluid stream, move slowly and are entrained in the spiraling fluid for a longer period before contacting the inner surfaces of dividing walls 50 or 60 which direct the particles to collection zones 53 and 62, respectively. The location of the upper or leading edge 51 of dividing wall 50 determines the cut point size of the particles in the outer annular fluid stream. As illustrated in FIGS. 8 and 9, the cut point of the coarse fraction is 40 microns. Particulate having a particle size greater than 40 microns will be withdrawn with the annular fluid stream in the outer collection zone 52. The location of leading edge 61 of the second dividing wall 60 determines the cut point size between the intermediate and fine fractions which are shown in FIGS. 8 and 9 is 15 microns. Thus, the particles in the intermediate fraction as shown in FIGS. 8 and 9 range from 15 to 40 microns in maximum dimension and they are withdrawn along with the annular fluid stream in collection zone 53. The fine fraction comprises particles less than 15 microns in maximum dimension and is withdrawn with the annular fluid stream in the collection zone 62. As is evident from FIGS. 8 and 9, the particle size separation can be easily adjusted by merely raising and lowering the dividing walls 50 and 60. Each of the separated fluid streams and the particles entrained therein are directed to separation equipment such as cyclones 21 and 23 wherein the particulate is removed from the carrier fluid stream. The fluid stream is preferably recycled to the classifier 10.

The size separations with the classifying system of the invention are very precise and oversized or undersized particles typically amount to less than 10% (by weight) of each separated size fraction.

The velocity of the separation medium through the classification zone 39 is for the most part controlled by the rotating blades 38 on the table cover 37. Movement of the separated annular streams with the entrained particulate matter from the individual collection zones 52 and 53, through the separators 21 and 23 and the return of the particle free fluid to the upper section 30 of the classifier 10 is controlled primarily by the blower or blowers (not shown) which generates a partial vacuum on the exhaust lines 24 and 25.

While the discussion of the invention herein has characterized the separation medium in general terms as a fluid, specifically air, the use of both liquid and gas is contemplated. It is believed that the predominant use of the present invention will be to classify particles less than about 250 microns (60 mesh, U.S.) in maximum dimension.

Modifications and improvements can be made to the present invention without departing from the scope thereof.

I claim:

1. A system for classifying particulate matter into a plurality of fractions in accordance with the particle size and density thereof, comprising:

(a) an annular, cylindrically shaped classification zone having concentric inner and outer boundaries;

(b) rotor means having rotating table to receive particulate matter on the upper surface thereof and to project the received particulate matter into a spiraling fluid stream within the annular classification zone from the inner boundary thereof in a substantially tangential direction whereby the particles pass radially through the spiraling fluid stream in accordance with the particle size or density thereof;

(c) table cover means above the rotating table supporting on the upper surface thereof fluid accelerating blades which generate the spiraling fluid stream within the annular classification zone;

(d) means to separate the spiraling fluid stream in the annular classification zone having the particulate matter distributed therein into a plurality of annular fluid streams whereby each of said separated streams contain a distinct size range of particles therein; and (e) means to remove the particulate matter in at least one of the separate fluid streams.

2. The system of claim 1 including blades on the upper surface of the rotating table adapted to receive particulate matter to accelerate particulate matter thereon and to project the particulate matter into the spiraling fluid stream with a tangential velocity essentially equivalent to the tangential velocity component of the spiraling fluid stream at the periphery of the table.

3. The system of claim 2, wherein the table is provided with said blades at least along the outer portion thereof to accelerate particulate matter thereon.

4. The system of claim 2, including diverter means around the edge of the table to reduce the radial velocity of the particulate to negligible levels and to accelerate the particulate to a tangential velocity essentially equal to the tangential velocity of the fluid stream at the perimeter of the table.

5. The system of claim 1, including at least one concentric, coaxial dividing wall at the end of the classifying zone to separate the moving annular fluid stream having particulate matter distributed therein into a plurality of annular fluid streams each of which contains a distinct size range of particles.

6. The system of claim 5, including means to adjust the position of at least one of the concentric, coaxial dividing wall in the axial direction to adjust the particle size separation between adjacent annular separated fluid streams.

7. The system of claim 5, wherein each of the separated fluid streams are passed through cyclones to remove particulate matter therefrom.

8. The system of claim 7, wherein the fluid stream discharged from each of the cyclones is passed through suitable means for removing dust therefrom.

9. The system of claim 8, wherein the dust removing means is a bag house.

10. A method for classifying particulate matter into a plurality of fractions in accordance with the particle size or density thereof, comprising:

(a) receiving unclassified particulate matter on a rotating table provided on a rotor means;

(b) generating a spiraling fluid stream in an annular, cylindrically shaped classification zone having inner and outer boundaries by means of fluid accelerating blades disposed on the upper surface of a table cover means above the rotating table;

(c) projecting unclassified particulate matter from the outer edge of the rotating table and through the inner boundary of the classification zone into the spiraling fluid stream in a substantially tangential direction, the particulate matter projected therein radially passing through the spiraling fluid stream in accordance with the particle size or density thereof;

(d) separating the fluid stream with the particulate matter entrained therein at the end of the classification zone into a plurality of annular fluid streams whereby each of said separated streams have entrained therein a distinct size range of particulate matter; and (e) removing entrained particulate from at least one of the separated fluid streams.

11. The method of claim 10, wherein each of the separated fluid streams with entrained particulate matter is passed through a cyclone to remove the entrained particulate therefrom.

12. The method of claim 10, wherein the unclassified particulate matter placed on the rotating table is accelerated by frictional engagement therewith.

13. The method of claim 12, wherein the particulate matter is further accelerated by blades positioned on the outer portion of the rotating table.

14. The method of claim 13, wherein the tangential velocity component of the particulate matter projected from the table into the fluid stream moving in the classification zone is essentially the same as the tangential velocity of the fluid stream at the outer perimeter of the table.

15. The method of claim 12, wherein the table is rotated at about 2,000 to about 7,500 revolutions per minute.

16. the method of claim 15, wherein the particulate matter is projected into the fluid stream as a uniform curtain of particulate matter.

* * * * *